United States Patent [19]

Tsuge

[11] Patent Number: 4,492,533

[45] Date of Patent: Jan. 8, 1985

[54] AIR COMPRESSOR

[75] Inventor: Kazuo Tsuge, Yokohama, Japan

[73] Assignee: Tokico Ltd., Kawasaki, Japan

[21] Appl. No.: 608,537

[22] Filed: May 9, 1984

Related U.S. Application Data

[63] Continuation of Ser. No. 272,266, Jun. 10, 1981.

[30] Foreign Application Priority Data

| | | | |
|---|---|---|---|
| Jun. 17, 1980 | [JP] | Japan | 55-85431[U] |
| Oct. 20, 1980 | [JP] | Japan | 55-149503 |
| Dec. 18, 1980 | [JP] | Japan | 55-182564 |

[51] Int. Cl.[3] ..... F04B 39/06; F04B 35/04

[52] U.S. Cl. ..... 417/372; 417/415

[58] Field of Search ..... 417/368, 372, 369, 312, 417/415

[56] References Cited

U.S. PATENT DOCUMENTS

| | | | |
|---|---|---|---|
| 2,019,689 | 11/1935 | Marbury | 417/415 X |
| 2,321,097 | 6/1943 | Mills | 417/372 X |
| 3,478,958 | 11/1969 | Hinck et al. | 417/312 X |

*Primary Examiner*—Richard E. Gluck
*Assistant Examiner*—Peter M. Cuomo
*Attorney, Agent, or Firm*—Oblon, Fisher, Spivak, McClelland & Maier

[57] ABSTRACT

An air compressor including a compressor unit, a drive unit for driving the compressor unit, a sound insulating box having an air inlet and an outlet and encasing the compressor and drive units, a fan positioned in the sound insulating box on the side of the air inlet for suctioning air thereinto, and a duct mounted in the sound insulating box. The duct has at one end opened toward the discharge side of the fan and the other end opened into at least one of the compressor and drive units where cooling is needed.

2 Claims, 6 Drawing Figures

AIR COMPRESSOR

This application is a continuation of application Ser. No. 272,266, filed June 10, 1981.

BACKGROUND OF THE INVENTION

This invention relates to air compressors, and more particularly to an air compressor which has a compressor unit and a rotary drive unit for the compressor unit accommodated in a sound insulating box for the purpose of noise reduction and which is provided with a fan within the sound insulating box for efficiently cooling the compressor and drive units.

There are known in the art the so-called package type air compressors in which the compressor and drive units are housed in a sound insulating box for noise reduction. The air compressors of this type have an inherent drawback in that the inside of the sound insulating box is heated considerably due to insufficient ventilation necessitating to provide a fan for cooling the compressor and drive units. In this regard, as the compressor unit is subjected to the highest temperature because of the compression heat which is generated upon compression of the air, the usual practice has been to direct the currents of the cooling air from the fan toward the outer wall surfaces of the compressor unit as much as possible.

However, the conventional air compressors which are arranged to supply the cooling air for the compressor unit indirectly from outside are unable to cool directly the interior of the compressor unit, for example, the bearings in the crank case or the inner wall portions of the cylinder head where considerable heat is generated, thus failing to produce sufficient cooling effect. Similarly, it has also been difficult to cool the interior of the drive unit to a sufficient degree, including the coil and rotor of the drive unit. Therefore, the compressor and drive units are deteriorated acceleratedly, resulting in a shortened service life.

With the foregoing in view, the present invention has as its object the provision of an air compressor of low noise, which is arranged to effectively cool the component parts of the compressor.

It is another object of the present invention to provide an air compressor employing a duct for conducting cooling air currents from a fan directly into at least either a compressor unit or a dirve unit for effectively cooling the interior of same.

It is still another object of the present invention to provide an air compressor which is arranged to take in a large quantity of air from a fan, supplying cooling air currents in high velocity to a place in need of the cooling air without causing pressure drops or temperature increases to the air on the way.

It is a further object of the present invention to provide an air compressor in which cooling air currents are sent directly to a rotor and a coil portion of a stator of the drive unit, or a bearing and cylinder portion of the compressor unit which generate high heat, preventing early exudation of grease in the bearing and deterioration of the seal ring to prolong the service lives of the drive unit and the compressor unit.

According to the present invention, the foregoing objects are achieved by an air compressor which comprises: a compressor unit; a drive unit for driving the compressor unit; a sound insulating box having an air inlet and an outlet and encasing the compressor and drive units; a fan positioned in the sound insulating box on the side of the air inlet for suctioning air thereinto; a duct mounted in the sound insulating box and having one end thereof opened toward the discharge side of the fan and the other end opened into at least one of the compressor and drive units where cooling is needed.

According to one aspect of the present invention, a fan is eccentrically mounted in a cylindrical sound insulating box with the duct located in a position where the outer periphery of the fan most approaches the inner peripheral wall of the sound insulating box, thereby causing the air currents gushing from the fan to form vortex of cooling air within the sound insulating box and taking in the cooling air with a duct at a point where the velocity of cooling air becomes highest for supply to a part or parts to be cooled.

The above and other objects of the invention will become apparent from the following description and the appended claims, taken in conjunction with the accompanying drawings which show by way of example preferred embodiments of the invention.

DESCRIPTION OF THE PREFERRED EMBODIMENTS

Figure 1:
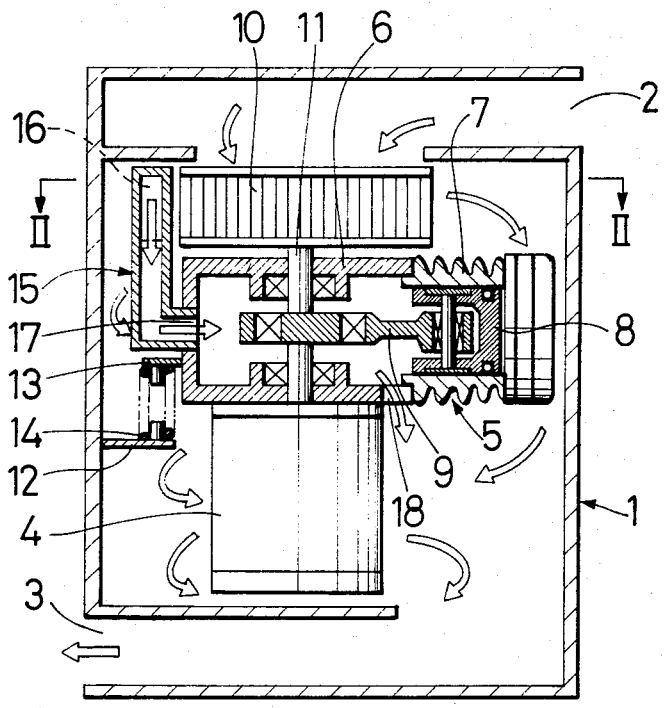
FIG. 1 is a vertical section of a first embodiment of the present invention.
Figure 2:
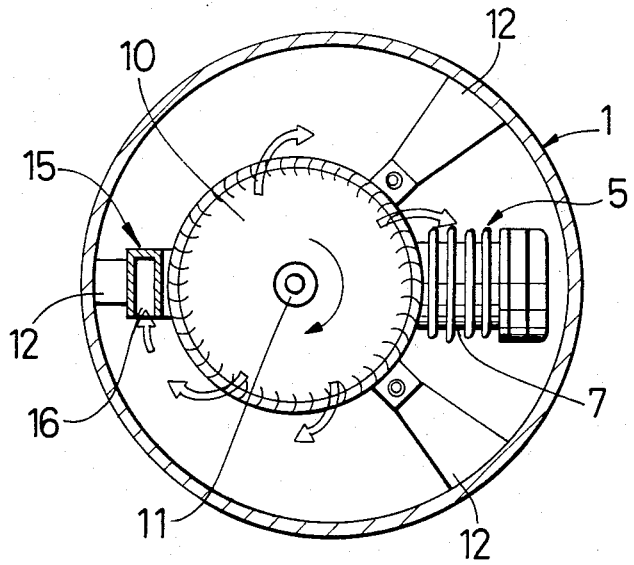
FIG. 2 is a cross-section taken on line II—II of FIG. 1.

Referring to FIGS. 1 and 2, there is shown a first embodiment of the air compressor according to the present invention, in which indicated at 1 is a cylindrical sound insulator box which is hermetically closed except an air inlet 2 and an air outlet 3 provided in the upper and lower portions thereof. The reference numeral 4 denotes a rotary drive unit which is powered, for example, by an AC power source, which mounts thereon an oiless type compressor unit 4. The compressor unit 5 includes a crank case 6, cylinder 7, a piston 8 slidably received in the cylinder 7, and a connecting rod 9. Indicated at 10 is an air blower which is located on the compressor unit 5 to take in air through the air inlet 2. A drive shaft 11 which is extended through the crank case 6 has its one end coupled with the drive unit 4 and the other end with the blower, for example, a multiblade fan. The drive shaft 11 is linked to the connecting rod 9 within the crank case 6. The compressor unit 5, drive unit 4 and blower 10 are suspendedly supported on a spring 14 which is interposed between a mounting arm 12 which is extended inwardly from the inner wall surface of the sound insulator box 1 and an opposing mounting arm 13 which is extended outwardly from the compressor unit 5.

Indicated at 15 is a vertical duct which has its inlet end 16 opened toward the circumference of the fan 10 to receive the output air currents therefrom. The other or the outlet end 17 of the duct 15 is opened into the crank case 6. Further, an air vent 18 is provided in the bottom wall of the crank case 6 to discharge the air from the outlet 17 of the duct 15 to the air outlet 3.

With an air compressor of the above-described construction, the drive shaft 11 is rotated upon starting the rotary drive unit 4, reciprocating the piston 8 through the connecting rod 9 to compress the air in the cylinder 7. At this time, especially the temperature of the cylinder 7 is raised by the compression heat, and the current of the air which is taken in through the inlet 2 by rotation of the fan 10 is directly fed to the duct 15 opening toward the air current delivered by the fan. Consequently, air currents of high pressure and velocity are blown into the crank case through the outlet end 17 of the duct 15 with almost no diminution. Within the crank case 6, the air cools off the bearing between the drive shaft 11 and the bearing between the connecting rod 9 and the piston pin, as well as the cylinder 7 and the piston 8. Thereafter, the air is discharged out of the sound insulating box 1 through the air vent 18 and the outlet 3. In this instance, the air currents from the fan 10 also cool off the outer surfaces of the compressor unit 5 and the drive unit 4.

Figure 3:
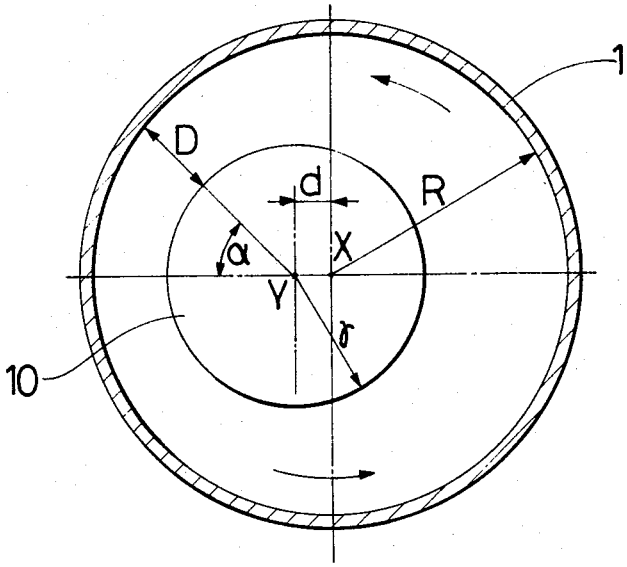
FIG. 3 is a diagrammatic view illustrating the flow of cooling air in the sound insulator box.

In the above-described embodiment, the air flows within the sound insulating box of the compressor take place as shown in the diagram of FIG. 3.

More specifically, the rotational axis Y of the fan 10 is deviated from the axis X of the sound insulating box 1 by d, so that the distance D between the outer periphery of the fan 10 and the inner periphery of the sound insulating box 1 becomes minimum in the direction of eccentricity of the fan 10, the distance D which is maximum when its angle $\alpha$ with the direction of eccentricity is 180° ($180°=\alpha$) increasing when $180°>\alpha$ and diminishing when $180°<\alpha$.

Thus, $$D/r = \frac{R}{r}\cos\left[\sin^{-1}\left(\frac{d/r}{R/r}\sin\alpha\right)\right] - \frac{d}{r}\cos\alpha - 1$$

(where R and r are radii of the sound insulating box 1 and the fan 10, respectively.) Therefore, the cooling air which gushes from the fan 10 forms a vortex within the sound insulating box 1 from its end on the side of the inlet 2 toward the opposite end on the side of the outlet 3. In this connection, it is advantageous to have $R/r=1.2$–$2.0$ and $d/r=0.1$–$0.6$ from the standpoint of encouraging the formation of the vortex.

Therefore, as shown in FIGS. 1 and 2, if the rotational axis of the fan 10 is positioned eccentrically with respect to the axis of the sound insulating box 1 with the inlet end 16 of the duct 15 located in a position confronting a circumferential portion of the fan 10 most proximal to the inner periphery of the sound insulating box 1, the amount of the air to be taken into the compressor 5 becomes greatest since the velocity of the air currents is highest at that position. This arrangement is also advantageous in that the outer surfaces of the drive unit 4 and compressor 5 are effectively cooled off by the vortex of the cooling air currents which are formed in the sound insulating box 1.

Figure 4:
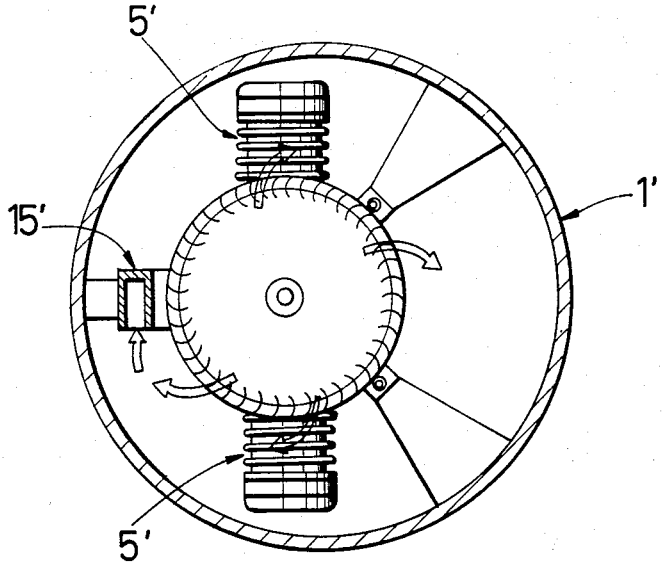
FIG. 4 is a view similar to FIG. 2 but showing another embodiment of the invention.

Although a mono-cylinder type compressor with a single cylinder 7 is shown in the foregoing embodiment, it is to be understood that there may be employed a multi-cylinder type which is provided with two or three cylinders. In such a case, it is preferred to position as shown in FIG. 4, in which cylinders 5', 5' are protruded opposingly in a sound insulating box 1', while a duct 15' being mounted on the same position as the foregoing embodiment.

Figure 5:
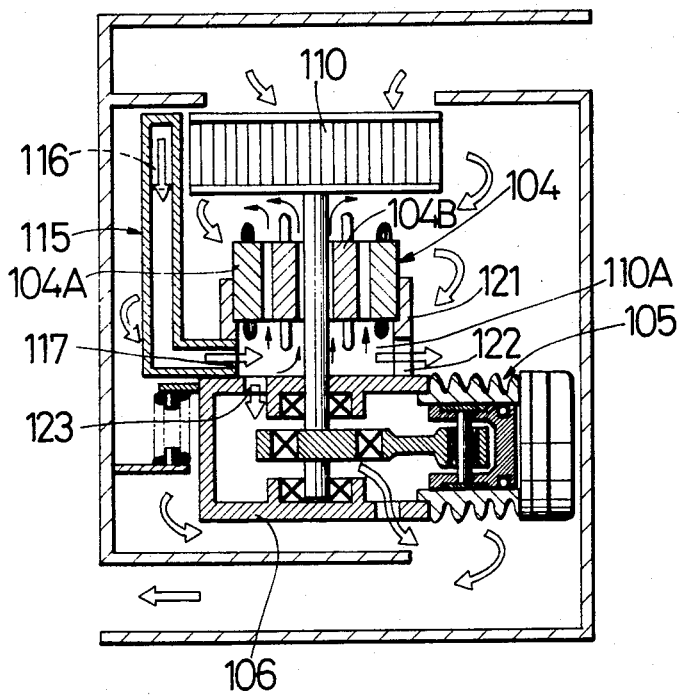
FIG. 5 is a vertical section of another embodiment of the invention.

Referring now to FIG. 5, there is illustrated another embodiment of the present invention, which is adapted to cool a drive unit 104 and a compressor 105 simultaneously. More specifically, in this particular embodiment, the drive unit 104 is positioned between the compressor 105 and a fan 110 which is supported on the compressor 105 through an annular support member 121, opening an outlet end 117 of a duct 115 into a chamber 110A in the support member 121. The support member 121 is provided with an air vent 122 in its circumferential wall, while the crank case 106 is formed with an air vent 123 in its top wall portion surrounded by the support member 121. In FIG. 5, indicated at 104A is a stator and at 104B a rotor of the drive unit 104, the rotor 104B being directly coupled with the drive shaft 111.

In the embodiment of FIG. 5, the air currents gushing from the fan 110 are led into the duct 115 through its inlet 116 and spouted through the outlet 117 into chamber 110A which is defined by the support member 121 and the crank case 106. The air spurted into the chamber 110A cools the interior of the drive unit 104, especially the coil portion of the stator 104A and the rotor 104B, and partly discharged through the air vent 122. The remainder is partly led through the air vent 123 into the crank case 106 to cool the interior of the air compressor 105. Although very small, the air flows through the gap between the stator 104A and rotor 104B, further enhancing the cooling effect on the drive unit 104.

Figure 6:
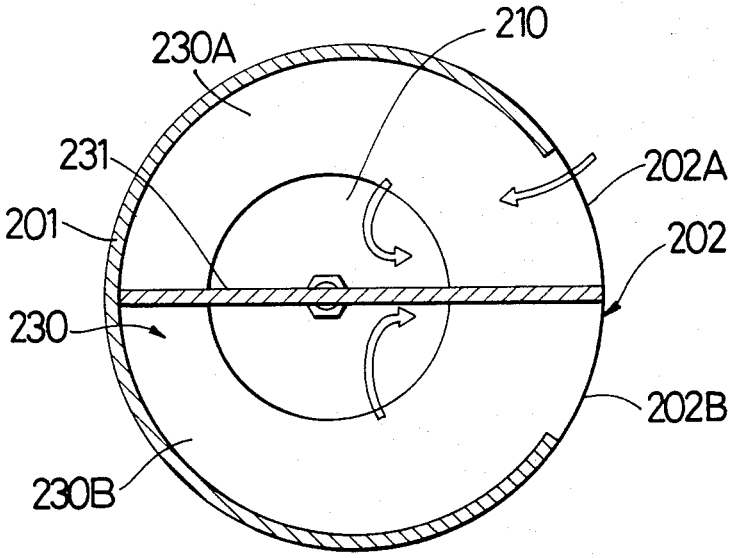
FIG. 6 is an enlarged vertical section of still another embodiment of the invention.

FIG. 6 illustrates a further embodiment of the present invention, in which a passage 230 leading from an air inlet 202 of a sound insulating box 201 to a fan 210 is divided into a plural number of sub-passages by a partition wall 231. The partition wall 231 is extended through the rotational axis of the fan 210 and the axis of the sound insulating box 201 to a mid point of the air inlet 202, dividing the passage 230 into sub-passages 230A and 230B of similar semi-circular shapes and at the same time bisecting the air inlet 202 into inlet openings 202A and 202B of similar shapes.

Generally, in a package type air compressor which is arranged to supply the air from the air inlet 202 to the fan 210 in the sound insulating box 201 through a passage 230, the amount of the air suctioned by the fan 210 is not entirely uniform along its circumference, expecially with an eccentrically located fan 210 which results in variations in the fluid resistance on the discharge side. Consequently, turbulent currents are produced on the suction side of the fan, producing noises and lowering the performance quality of the fan. The above-mentioned partition wall 231 which is provided in the passage 230 serves to eliminate these troubles, guiding therealong the air to rectify the air currents to be supplied to the fan 210. As a matter of fact, it contributes to reduce the noises to a considerable degree (about 2dB(A)) and to increase the air feed by about 15%.

Though the air compressors in the foregoing embodiments are provided with only one duct, there may be provided a plural number of ducts which are directed to a number of localities where cooling is needed. For example, in the embodiment of FIG. 5, the air may be admitted into the chamber 110A in support member 121 and into the crank case 106 through two separate ducts 115. Further, the fan which has been described and shown as a multi-blade type fan may be an axial fan or a turbofan or any other type as long as its permits installation of the air inlet of the duct in the vicinity of its delivery side. If desired, the outlet of the duct may be directed, for example, to a cylinder portion which needs cooling, instead of opening it into the crank case. Moreover, the duct which has been shown as being provided independently in the sound insulating box may be formed along the inner or outer wall surfaces of the latter.

What is claimed as new and desired to be secured by Letters Patent of the United States is:

1. An air compressor, comprising:

a compressor unit;

a drive unit having a drive shaft for driving said compressor unit;

a circular cylindrical sound insulating box having a longitudinal axis extending parallel to said drive shaft, said box having an air inlet and an outlet and encasing said compressor and drive units;

a fan mounted on said drive shaft and positioned eccentrically from said axis of said sound insulating box and sucking air axially from said air inlet to supply cooling air to the interior of said sound insulating box from the outer periphery thereof;

a duct mounted in said sound insulating box at a position where an outer periphery of said fan most closely approaches an inner peripheral wall of said sound insulating box;

an inlet of said duct opening between the outer periphery of said fan and inner peripheral wall of said sound insulating box;

an outlet of said duct opening to the interior of at least one of said drive unit and said compressor unit; and a chamber providing communication between said drive unit and compressor unit.

2. The air compressor of claim 1, wherein said outlet of said duct opens toward both said drive unit and said chamber, allowing the introduction of cooling air from said chamber into said compressor unit.

* * * * *